US007976399B1

(12) United States Patent
Pritchett

(10) Patent No.: US 7,976,399 B1
(45) Date of Patent: Jul. 12, 2011

(54) GOLF CLUB SWING ALIGNMENT SYSTEM

(76) Inventor: Ronnie Pritchett, Ramona, CA (US)

( * ) Notice: Subject to any disclaimer, the term of this patent is extended or adjusted under 35 U.S.C. 154(b) by 0 days.

(21) Appl. No.: 12/714,694

(22) Filed: Mar. 1, 2010

(51) Int. Cl.
*A63B 53/02* (2006.01)
*A63B 69/36* (2006.01)

(52) U.S. Cl. ..... 473/231; 473/238; 473/242; 473/305

(58) Field of Classification Search ..... 473/219–256, 473/305–315, 324; D21/746, 759
See application file for complete search history.

(56) References Cited

U.S. PATENT DOCUMENTS

| | | | | | |
|---|---|---|---|---|---|
| 1,126,208 | A | * | 1/1915 | Hayford | 473/201 |
| 1,433,150 | A | * | 10/1922 | Reach | 473/251 |
| 1,488,900 | A | * | 4/1924 | Armstrong | 473/201 |
| 1,603,850 | A | * | 10/1926 | Keating | 473/242 |
| 2,219,670 | A | * | 10/1940 | Wettlaufer | 473/247 |
| 2,865,635 | A | * | 12/1958 | Jessen | 473/201 |
| 3,311,377 | A | | 3/1967 | Holbus | |
| 3,328,032 | A | | 6/1967 | Griswold | |
| 3,848,874 | A | * | 11/1974 | Elkins, Jr. | 473/409 |
| 4,222,567 | A | * | 9/1980 | Shabala | 473/242 |
| 4,231,576 | A | * | 11/1980 | Perkins | 473/242 |
| 4,317,568 | A | * | 3/1982 | Green | 473/238 |
| 4,569,525 | A | * | 2/1986 | Folger | 473/242 |
| 4,746,124 | A | * | 5/1988 | Comitz | 473/254 |
| 4,971,328 | A | | 11/1990 | Hernberg | |
| 5,152,533 | A | * | 10/1992 | Radakovich | 473/206 |
| 5,158,297 | A | * | 10/1992 | Johnson | 473/238 |
| 5,234,217 | A | * | 8/1993 | Johnson | 473/238 |
| 5,348,303 | A | | 9/1994 | Swissheim | |
| 5,427,376 | A | * | 6/1995 | Cummings et al. | 473/201 |
| 5,441,274 | A | * | 8/1995 | Clay | 473/201 |
| 5,527,038 | A | | 6/1996 | Mabie | |
| 5,542,666 | A | * | 8/1996 | Chou | 473/314 |
| 5,879,164 | A | | 3/1999 | De Jesus | |
| 6,200,227 | B1 | * | 3/2001 | Sery | 473/251 |
| 6,648,770 | B1 | | 11/2003 | Snyder | |
| 6,739,980 | B2 | | 5/2004 | Scott et al. | |
| 7,101,288 | B2 | * | 9/2006 | Thomas | 473/242 |
| 2002/0160849 | A1 | * | 10/2002 | Thomas | 473/251 |
| 2009/0286612 | A1 | * | 11/2009 | Pouliot et al. | 473/251 |
| 2010/0216566 | A1 | * | 8/2010 | Thomas et al. | 473/242 |

* cited by examiner

*Primary Examiner* — Sebastiano Passaniti
(74) *Attorney, Agent, or Firm* — Gordon & Rees LLP

(57) ABSTRACT

A golf club alignment system, including: (a) a golf club shaft; (b) a golf club head connected to the golf club shaft, the golf club head including: (i) a hosel received onto an end of the golf club shaft; (ii) a ball-hitting face extending from the hosel; and (iii) an alignment system on the hosel, wherein the alignment system comprises a longitudinally extending marker positioned in a plane passing through a center axis of the golf club, and wherein the longitudinally extending marker terminates in an arrow point at the upper end of the hosel.

7 Claims, 5 Drawing Sheets

GOLF CLUB SWING ALIGNMENT SYSTEM

TECHNICAL FIELD

The present invention relates to systems for aligning golf club swings.

SUMMARY OF THE INVENTION

The present invention provides a golf club alignment system, comprising: (a) a golf club shaft; (b) a golf club head connected to the golf club shaft, the golf club head comprising: (i) a hosel received onto an end of the golf club shaft; (ii) a ball-hitting face extending from the hosel; and (iii) an alignment system on the hosel, wherein the alignment system comprises a longitudinally extending marker positioned in a plane passing through a center axis of the golf club shaft.

In preferred embodiments, the longitudinally extending marker terminates in an arrow point at the upper end of the hosel; and the hosel has a pointed top end aligned with the arrow point of the longitudinally extending marker.

The present invention also provides a method of aligning a golf club prior to a swing, comprising: a user holding a golf club; the user viewing an alignment system on a golf club, the alignment system comprising a longitudinally extending marker positioned in a plane passing through a center axis of the golf club shaft; and the user rotating the golf club. Specifically, the user rotates the golf club while looking directly down the length of the longitudinally extending marker such that the top and bottom ends of the longitudinally extending marker are aligned with one another, and with the golfer's line of sight. As a result, the longitudinally extending marker is rotated to a position such that its top and bottom ends appears aligned with a center axis of the golf club shaft as viewed by the user.

DETAILED DESCRIPTION OF THE DRAWINGS

Figure 1:
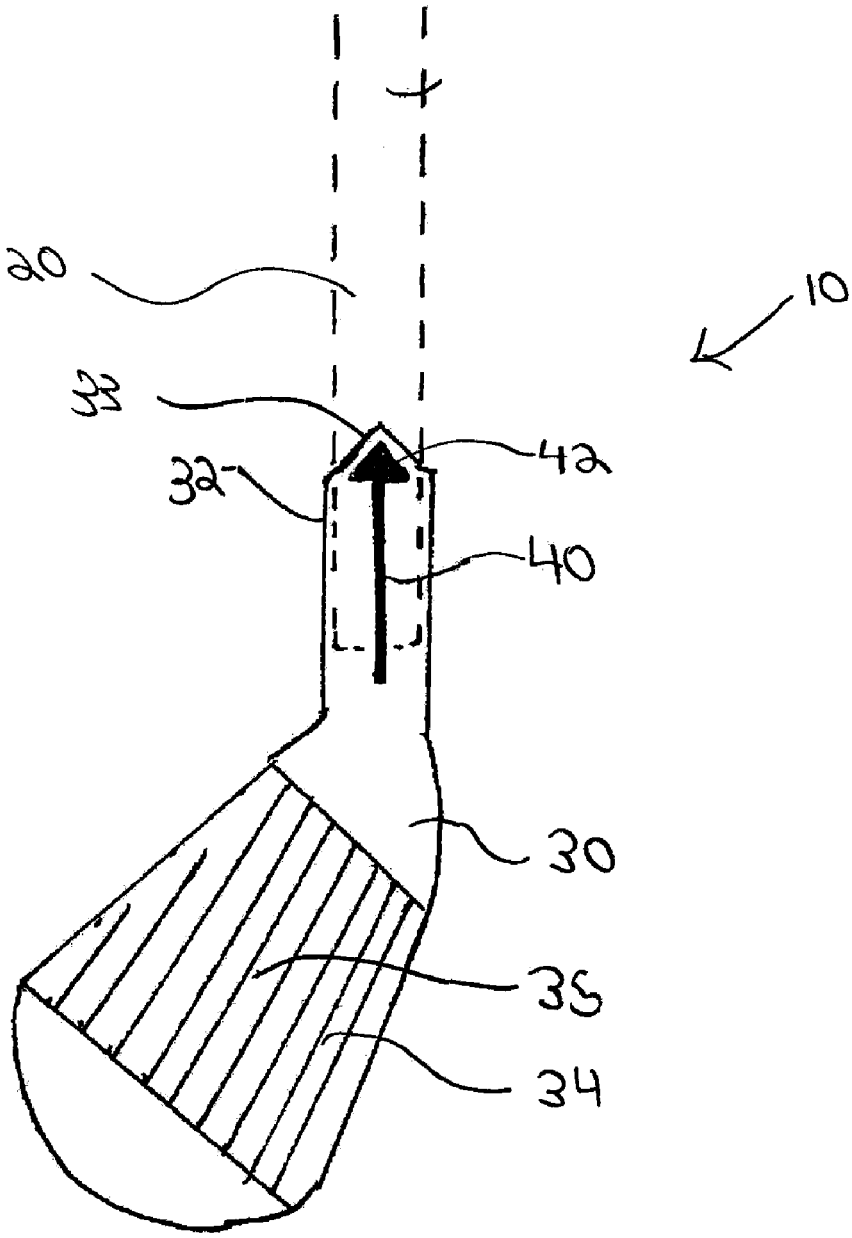
FIG. 1 is a perspective view of the present invention.

FIG. 1 illustrates a perspective view of alignment system 10, comprising: a golf club shaft 20; and a golf club head 30 connected to golf club shaft 20. Golf club head 30 comprises a hosel 32 received onto an end of golf club shaft 20. Golf club head 30 further comprises a ball-hitting face 34 extending downwardly from hosel 32. Golf club head 30 further comprises an alignment system 40 on hosel 32. Alignment system 40 comprises a longitudinally extending marker, as shown.

Figure 2:
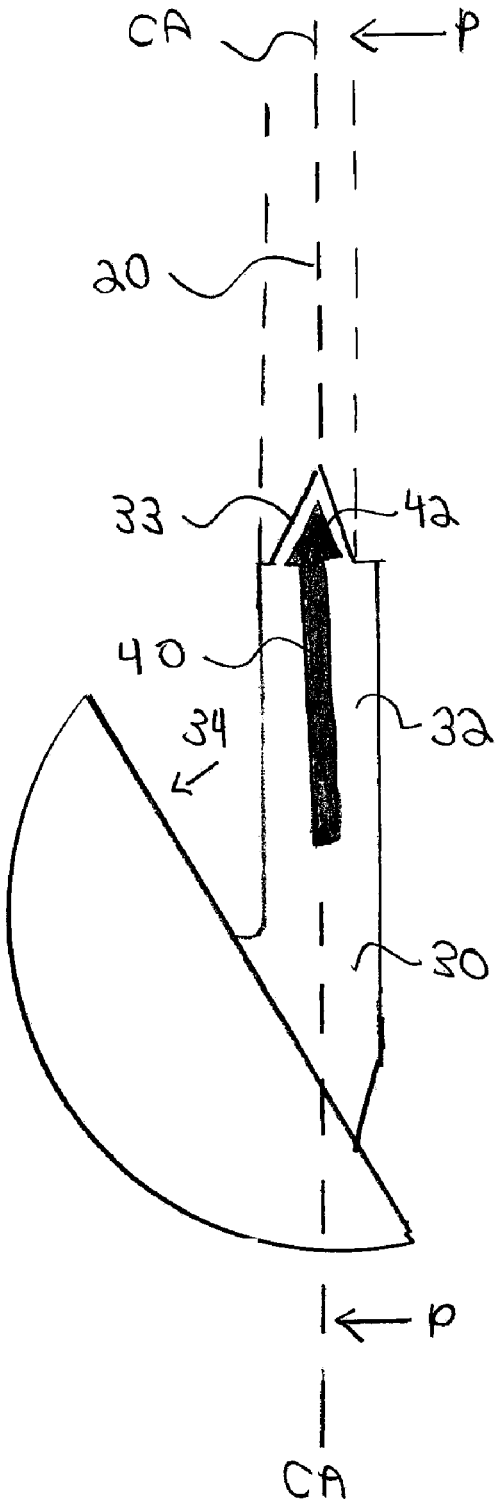
FIG. 2 is a side elevation view of the invention.

FIG. 2 illustrates a side elevation view of alignment system 10. As can be seen, longitudinally extending marker 40 is positioned in a plane P passing through a center axis CA of golf club shaft 20. As can also be seen, the longitudinally extending marker 40 terminates in an arrow point 42 at the upper end of hosel 32. As is also illustrated, hosel 32 may have an optional pointed top end 33 aligned with arrow point 42 of longitudinally extending marker 40.

In various embodiments, the pointed top end 33 of hosel 32 has a length of less than 1 inch; the center of the longitudinally extending marker 40 has a width of less than ¼ inch; and the arrow point 42 of longitudinally extending marker 40 has a width of less than ½ inch. In various embodiments, the longitudinally extending marker 40 has a length of less than 1½ inches; and most preferably the longitudinally extending marker 40 has a length of about 1 inch. It is to be understood, however, that the above dimensions are merely exemplary, and that the present invention is not limited by these dimensions.

Figure 3A:
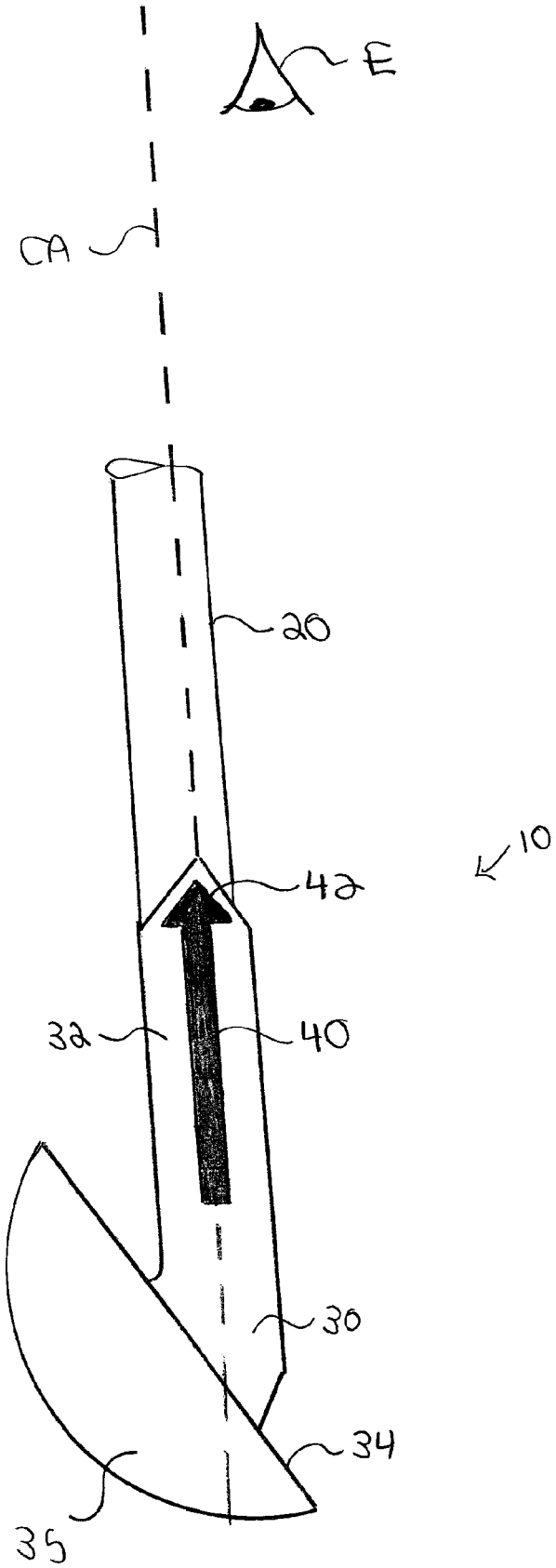
FIG. 3A shows the alignment system of the golf club as seen by a golfer with the golf club rotated to a first non-aligned position (prior to the golfer making a hook swing).
Figure 3B:
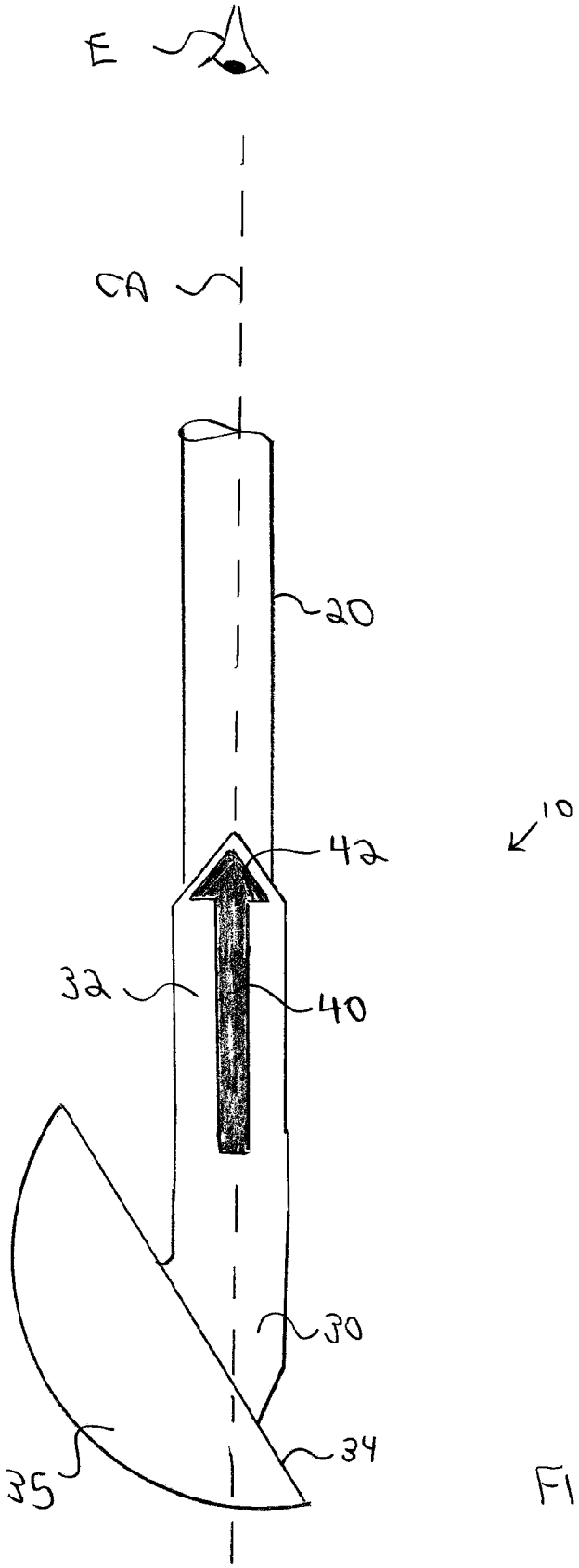
FIG. 3B shows the alignment system of the golf club as seen by a golfer with the golf club rotated to a second aligned position (prior to the golfer making an optimal swing).
Figure 3C:
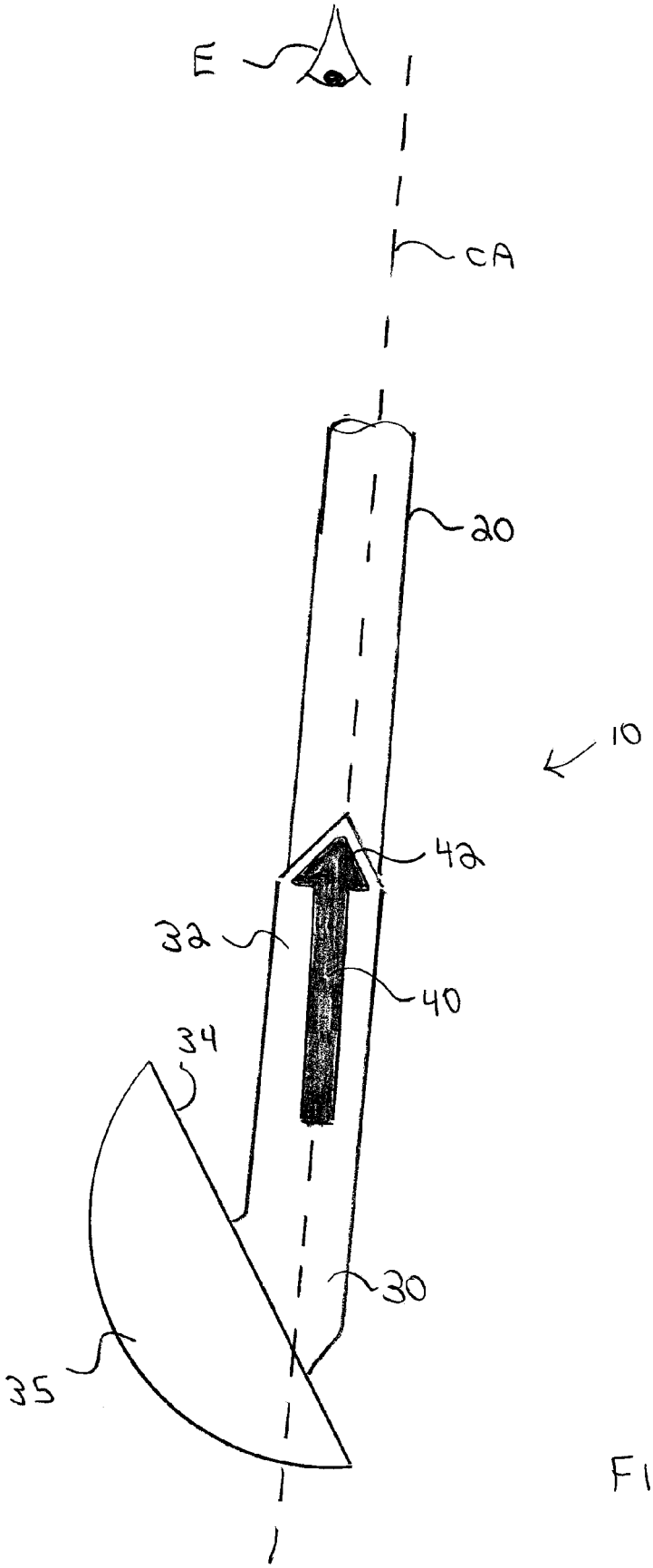
FIG. 3C shows the alignment system of the golf club as seen by a golfer with the golf club rotated to a third non-aligned position (prior to the golfer making a slice swing).

FIGS. 3A to 3C illustrate various orientations of the golf club as viewed by the golfer as the golfer rotates the club (in a direction perpendicular to center axis CA) to various positions. The eye E of the golfer looking down the golf club shaft 20 is also illustrated. Alignment is performed by the golfer as follows.

Should the golfer swing with the club in position 3A, the swing will be a "hook" causing the ball to veer to the left of the target. Conversely, should the golfer swing with the club in position 3C, the swing will be "slice" causing the ball to veer to the right of the target. Therefore, the objective of the present alignment system 10 is to have the golfer swing the club with the club being in position 3B prior to the swing. This will ensure that the swing is neither a hook nor a slice.

To align the club to the preferred swing position of FIG. 3B, the golfer rotates golf club shaft 20 while looking directly down the length of club shaft 20 and longitudinally extending marker 40. Golf club shaft 20 is rotated to a position such that the top and bottom ends of longitudinally extending marker 40 are aligned with one another, and with the golfer's line of sight (from eye E). As a result, longitudinally extending marker 40 is rotated to a position such that its top and bottom ends also appears aligned with center axis CA of the golf club shaft, and the center axis CA is aligned with the golfer's line of sight.

Accordingly, the present invention also includes a method of aligning a golf club prior to a swing, comprising: a user holding golf club shaft 20; the user viewing the alignment system 40 on the golf club (the alignment system comprising a longitudinally extending marker 40 positioned in a plane P passing through a center axis CA of golf club shaft 20). Next, the golfer rotates golf club shaft 20 such that the top and bottom ends of the longitudinally extending marker 40 are aligned with the view of the golfer. In other words, if the golfer sees marker 40 in the position of FIG. 3A, then the golfer rotates the club to the position shown in FIG. 3B. Conversely, if the golfer sees marker 40 in the position of FIG. 3C, then the golfer rotates the club (in the opposite direction) to the position shown in FIG. 3B. As a result, the longitudinally extending marker 40 is rotated to a position such that it appears aligned, as shown.

What is claimed is:

1. A golf club alignment system, comprising:

(a) a golf club shaft;

(b) a golf club head connected to the golf club shaft, the golf club head comprising:

(i) a hosel received onto an end of the golf club;

(ii) a ball-hitting face extending from the hosel; and (iii) an alignment system on the hosel, wherein the alignment system comprises a longitudinally extending marker positioned in a plane passing through a center axis of the golf club shaft, and wherein the longitudinally extending marker terminates in an arrow point at the upper end of the hosel, wherein the hosel has a pointed top end aligned with the arrow point of the longitudinally extending marker.

2. The system of claim 1, wherein the pointed top end of the hosel has a length of less than 1 inch.

3. The system of claim 1, wherein the center of the longitudinally extending marker has a width of less than ¼ inch.

4. The system of claim 1, wherein the arrow point of the longitudinally extending marker has a width of less than ½ inch.

5. The system of claim 1, wherein the longitudinally extending marker has a length of less than 1½ inches.

6. The system of claim 1, wherein the longitudinally extending marker has a length of about 1 inch.

7. A golf club alignment system, comprising:

a golf club head comprising:

(i) a hosel;

(ii) a ball-hitting face extending from the hosel; and (iii) an alignment system on the hosel, wherein the alignment system comprises a longitudinally extending marker positioned in a plane passing through a center axis of the golf club, and wherein the longitudinally extending marker terminates in an arrow point at the upper end of the hosel, wherein the hosel has a pointed top end aligned with the arrow point of the longitudinally extending marker.

* * * * *